US011362413B2

(12) United States Patent
Plet et al.

(10) Patent No.: US 11,362,413 B2
(45) Date of Patent: Jun. 14, 2022

(54) ANTENNA ASSEMBLY

(71) Applicant: Nokia Shanghai Bell Co., Ltd., Shanghai (CN)

(72) Inventors: Jerome Plet, Louannec (FR); Jean Pierre Harel, Lannion (FR); Zied Charaabi, Lannion (FR); Patrick Le Cam, Ploubezre (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 16/977,949

(22) PCT Filed: Mar. 6, 2019

(86) PCT No.: PCT/CN2019/077222
§ 371 (c)(1),
(2) Date: Sep. 3, 2020

(87) PCT Pub. No.: WO2019/170112
PCT Pub. Date: Sep. 12, 2019

(65) Prior Publication Data

US 2021/0091454 A1 Mar. 25, 2021

(30) Foreign Application Priority Data

Mar. 7, 2018 (EP) ..... 18305242

(51) Int. Cl.
*H01Q 1/24* (2006.01)
*H01Q 1/38* (2006.01)
(Continued)

(52) U.S. Cl.
CPC ..... *H01Q 1/24* (2013.01); *H01Q 1/246* (2013.01); *H01Q 1/38* (2013.01); *H01Q 1/52* (2013.01);
(Continued)

(58) Field of Classification Search
CPC ..... H01Q 1/24; H01Q 1/526; H01Q 5/321; H01Q 9/285; H01Q 5/42; H01Q 21/26;
(Continued)

(56) References Cited

U.S. PATENT DOCUMENTS 4,746,925 A * 5/1988 Toriyama ..... H01Q 1/1271 343/700 MS
6,377,227 B1 4/2002 Zhu et al.
(Continued)

FOREIGN PATENT DOCUMENTS

CN 2515811 Y 10/2002
CN 201048157 Y 4/2008
(Continued)

OTHER PUBLICATIONS

Fan Fan He et al., "Suppression of Second and Third Harmonies Using λ/4 Low-Impedance Substrate Integrated Waveguide Bias Line in Power Amplifier", IEEE Microwave and Wireless Components Letters, vol. 18, No. 7, Jul. 2008, pp. 479-481.
(Continued)

*Primary Examiner* — Hai V Tran
(74) *Attorney, Agent, or Firm* — Fay Sharpe LLP

(57) ABSTRACT

An antenna assembly and method are disclosed. The antenna assembly comprises: a printed circuit board assembly having a radiating element layer and a choke structure, the choke structure having a central conductor and a shielding structure, wherein the central conductor comprises at least a portion of the radiating element layer. By providing a printed circuit board assembly having a radiating element layer and a choke structure which utilises a portion of the radiating element layer, the manufacture of the radiating elements is simplified.

18 Claims, 5 Drawing Sheets

(51) Int. Cl.

| | |
|---|---|
| ***H01Q 1/52*** | (2006.01) |
| ***H01Q 5/321*** | (2015.01) |
| ***H01Q 5/42*** | (2015.01) |
| ***H01Q 9/28*** | (2006.01) |
| ***H01Q 21/26*** | (2006.01) |

(52) U.S. Cl.
CPC ..... *H01Q 1/521* (2013.01); *H01Q 1/526* (2013.01); *H01Q 5/321* (2015.01); *H01Q 5/42* (2015.01); *H01Q 9/28* (2013.01); *H01Q 9/285* (2013.01); *H01Q 21/26* (2013.01)

(58) Field of Classification Search
CPC ..... H01Q 1/38; H01Q 1/521; H01Q 1/246; H01Q 1/52; H01Q 9/28
USPC ..... 343/700 R
See application file for complete search history.

(56) References Cited

U.S. PATENT DOCUMENTS

| | | | | |
|---|---|---|---|---|
| 6,987,483 | B2 * | 1/2006 | Tran | H01Q 1/38 343/700 MS |
| 2002/0139993 | A1 | 10/2002 | Aoki et al. | |
| 2007/0097008 | A1 * | 5/2007 | Chen | H01Q 9/285 343/795 |
| 2008/0158083 | A1 * | 7/2008 | Apostolos | H01Q 5/40 343/791 |
| 2009/0002251 | A1 | 1/2009 | Pintos et al. | |
| 2009/0195459 | A1 * | 8/2009 | Chua | H01Q 9/04 343/700 MS |
| 2015/0214617 | A1 | 7/2015 | Shang et al. | |
| 2016/0301129 | A1 * | 10/2016 | Ying | H01Q 5/10 |
| 2016/0365645 | A1 | 12/2016 | Bisiules | |
| 2017/0294704 | A1 * | 10/2017 | Sun | H01Q 15/14 |
| 2017/0310009 | A1 * | 10/2017 | Isik | H01Q 21/062 |

FOREIGN PATENT DOCUMENTS

| | | | |
|---|---|---|---|
| CN | 104067527 | A | 9/2014 |
| CN | 203826551 | U | 9/2014 |
| CN | 107078390 | A | 8/2017 |
| CN | 107275804 | A | 10/2017 |
| CN | 107743665 | A | 2/2018 |
| EP | 2159875 | A1 | 3/2010 |
| EP | 2835864 | A1 | 2/2015 |
| JP | 2007-243375 | A | 9/2007 |
| JP | 2015122700 | A | 7/2015 |

OTHER PUBLICATIONS

Written Opinion of the International Searching Authority for PCT Application No. PCT/CN2019/077222, dated May 29, 2019, 3 pages.

Extended European Search Report for EP Application No. 18305242.2, dated Aug. 6, 2018, 11 pages.

English Bibliography of Chinese Application No. CN201048157Y, Published on Apr. 16, 2008, Printed from Derwent Innovation on Nov. 18, 2020, 6 pages.

English Bibliography of Japanese Application No. JP2015122700A, Published on Jul. 2, 2015, Printed from Derwent Innovation of Nov. 18, 2020, 6 pages.

English Bibliography of Chinese Application No. CN104067527A, Published on Sep. 24, 2014, Printed from Derwent Innovation on Mar. 10, 2021, 7 pages.

English Bibliography of Chinese Application No. CN107078390A, Published on Aug. 18, 2017, Printed from Derwent Innovation on Mar. 10, 2021, 7 pages.

English Bibliography of Chinese Application No. CN107275804A, Published on Oct. 20, 2017, Printed from Derwent Innovation on Mar. 10, 2021, 6 pages.

English Bibliography of Chinese Application No. CN107743665A, Published on Feb. 27, 2018, Printed from Derwent Innovation on Mar. 10, 2021, 6 pages.

English Bibliography of Japanese Application No. JP2007243375A, Published on Sep. 20, 2007, Printed from Derwent Innovation of Mar. 10, 2021, 5 pages.

International Search Report for PCT/CN2019/077222 dated May 29, 2019.

* cited by examiner

ANTENNA ASSEMBLY

TECHNICAL FIELD

The technical field relates to an antenna assembly and method.

BACKGROUND

Current trends in cellular communications systems integrate more and more frequency bands. The consequence is that most base station antennas are now required to be multiband. These multiband antennas are generally made of phased array elements, which are closely interleaved, creating many non-desired interactions between the radiating elements of different bands. Although these antenna assemblies support multiband communication, they each have their own shortcomings. Accordingly, it is desired to provide an improved antenna assembly.

SUMMARY

According to a first aspect, there is provided an antenna assembly, comprising: a printed circuit board assembly having a radiating element layer and a choke structure, the choke structure having a central conductor and a shielding structure, wherein the central conductor comprises at least a portion of the radiating element layer.

The first aspect recognises that in a configuration of multiband antenna 10, as shown schematically in FIG. 1, several high-band radiating elements 20 (operating in, for example, the 1700-2700 MHz or 3300-3800 MHz frequency bands) are located in the close vicinity of each low-band radiating element 30 (operating in, for example, the 690-960 MHz band). This induces perturbations on S-parameters and patterns of all the radiating elements. As the low-band radiating elements 30 are relatively large compared to the high-band radiating elements 20, the perturbation is generally worse in the high-band frequencies experienced by the low-band radiating elements 30, although all radiating elements experience some perturbation. The first aspect also recognises that in order to reduce the perturbation, some kind of "filter" or "choke" can be incorporated along each low-band element 30, to try to reduce the high-band currents on these elements. The low-band element 30 appears therefore as if cut into smaller parts, compared to the high-band wavelength, which are isolated from each other. The high-band perturbation is then significantly reduced. In particular, to block the non-desired currents one or more chokes can be placed along the conductor of the radiating element. However, manufacturing radiating elements incorporating such chokes can be problematic. By providing a printed circuit board assembly having a radiating element layer and a choke structure which utilises a portion of the radiating element layer, the manufacture of the radiating elements is simplified.

In one embodiment, the shielding structure at least partially surrounds the portion of the radiating element layer. This provides a compact arrangement that is easy to assemble.

In one embodiment, the shielding structure comprises at least one conductive layer separated from the portion of the radiating element layer by a dielectric layer of the printed circuit board assembly.

In one embodiment, the shielding structure comprises at least a pair of conductive layers, each separated from the portion of the radiating element layer by a respective dielectric layer of the printed circuit board assembly.

In one embodiment, the radiating element layer is sandwiched between the pair of dielectric layers.

In one embodiment, the pair of conductive layers is formed on outward major faces of the pair of dielectric layers.

In one embodiment, the shielding structure comprises conductive vias extending through the dielectric layers between the pair of conductive layers.

In one embodiment, the vias electrically couple the conductive layers with the portion of the radiating element layer.

In one embodiment, the printed circuit board assembly comprises stacked first and second dielectric layers having adjoining major faces, the first dielectric layer having the portion of the radiating element layer formed on its adjoining major face and a first conductive layer formed on its outer major face, the second dielectric layer having a second conductive layer formed on its outer major face. This provides an antenna assembly having integrated chokes which is easy to assemble.

In one embodiment, the second dielectric layer has a further conductive layer formed on its adjoining major face and the printed circuit board assembly comprises an insulating layer positioned between the adjoining major faces. This provides an antenna assembly having integrated chokes which is easy to assemble from stacked printed circuit boards, with capacitive coupling between the boards.

In one embodiment, the portion of the radiating element layer is shaped to extend within an area defined by the conductive layers.

In one embodiment, the portion of the radiating element layer comprises a pair of bent elements which extend initially away from an elongate length of a continuous part of the portion of the radiating element and turn to extend generally parallel to the elongate length of the continuous part of the portion of the radiating element.

In one embodiment, a length of each bent element defines its effective electrical length. It will be appreciated that the effective electrical length will also be dependent on the relative permittivity of the adjacent dielectric layers.

In one embodiment, the vias electrically couple the pair of conductive layers with the portion of the radiating element layer.

In one embodiment, a plurality of the vias is positioned to provide the choke with an RF short circuit at one end of the portion of the radiating element layer.

In one embodiment, the vias are positioned to provide the choke with an RF open circuit at another end of the portion of the radiating element layer.

In one embodiment, the shielding structure defines an effective electrical length of the choke structure.

In one embodiment, the shielding structure is dimensioned to provide the effective electrical length corresponding to a quarter of a wavelength to be attenuated. For example, in order to block 3.5 GHz (0.099 m wavelength) currents: wavelength/4@3.5 GHz in a PCB structure having a permittivity of 2.55 DK gives an effective electrical length of 14.7 mm.

In one embodiment, the vias are positioned with an inter-via spacing having an effective electrical length corresponding to no more than one tenth of a wavelength to be attenuated.

In one embodiment, the vias are positioned with an inter-via spacing having an effective electrical length corresponding to no more than one twentieth of the wavelength to be attenuated.

In one embodiment, the antenna assembly comprises a plurality of the shielding structures collocated to share the portion of the radiating element layer as a common central conductor. Hence, more than one choke may be provided on the radiating element layer to provide for enhanced perturbation reduction.

In one embodiment, each shielding structure is dimensioned to provide one of identical and different effective electrical lengths. Hence, the multiple chokes may reduce perturbations at the same and/or different frequencies.

In one embodiment, the plurality of the shielding structures comprises a plurality of the pairs of conductive layers, each separated by a dielectric layer of the printed circuit board assembly. Hence, more than one choke may be stacked on each other to provide for enhanced perturbation reduction.

In one embodiment, each pair of conductive layers is dimensioned to provide one of identical and different effective electrical lengths. Hence, the multiple chokes may reduce perturbations at the same and/or different frequencies.

In one embodiment, the plurality of the shielding structures comprises a plurality of the pairs of bent elements extending from the portion of the radiating element layer.

In one embodiment, each of the plurality of the pairs of bent elements has one of identical and different effective electrical lengths. Hence, the multiple chokes may reduce perturbations at the same and/or different frequencies.

In one embodiment, the antenna assembly comprises a plurality of the choke structures.

In one embodiment, the plurality of choke structures is arranged in series along the radiating element layer.

In one embodiment, the radiating element layer comprises one of a monopole and a dipole.

In one embodiment, the antenna assembly comprises an antenna device comprising the printed circuit board assembly.

In one embodiment, the antenna assembly comprises a radio system comprising the printed circuit board assembly.

According to a second aspect, there is provided an antenna device comprising the antenna assembly of the first aspect and its embodiments.

According to a third aspect, there is provided a method, comprising: providing a printed circuit board assembly having a radiating element layer and a choke structure, the choke structure having a central conductor and a shielding structure, wherein the central conductor comprises at least a portion of the radiating element layer.

In one embodiment, the method comprises at least partially surrounding the portion of the radiating element layer with the shielding structure.

In one embodiment, the shielding structure comprises at least one conductive layer separated from the portion of the radiating element layer by a dielectric layer of the printed circuit board assembly.

In one embodiment, the shielding structure comprises at least a pair of conductive layers, each separated from the portion of the radiating element layer by a respective dielectric layer of the printed circuit board assembly.

In one embodiment, the method comprises sandwiching the radiating element layer between the pair of dielectric layers.

In one embodiment, the method comprises forming the pair of conductive layers on outward major faces of the pair of dielectric layers.

In one embodiment, the shielding structure comprises conductive vias extending through the dielectric layers between the pair of conductive layers.

In one embodiment, the method comprises electrically coupling the conductive layers with the portion of the radiating element layer with the vias.

In one embodiment, the printed circuit board assembly comprises stacked first and second dielectric layers having adjoining major faces and the method comprises forming the portion of the radiating element layer on an adjoining major face of the first dielectric layer, forming a first conductive layer on an outer major face of the first dielectric layer, and forming a second conductive layer on an outer major face of the second dielectric layer.

In one embodiment, the method comprises forming a further conductive layer on an adjoining major face of the second dielectric layer and positioning an insulating layer between the adjoining major faces.

In one embodiment, the method comprises shaping the portion of the radiating element layer to extend within an area defined by the conductive layers.

In one embodiment, the portion of the radiating element layer comprises a pair of bent elements shaped to extend initially away from an elongate length of a continuous part of the portion of the radiating element and turn to extend generally parallel to the elongate length of the continuous part of the portion of the radiating element.

In one embodiment, a length of each bent element defines its effective electrical length.

In one embodiment, the method comprises electrically coupling the pair of conductive layers with the portion of the radiating element layer using the vias.

In one embodiment, the method comprises positioning a plurality of the vias to provide the choke with an RF short circuit at one end of the portion of the radiating element layer.

In one embodiment, the method comprises positioning the vias to provide the choke with an RF open circuit at another end of the portion of the radiating element layer.

In one embodiment, the shielding structure defines an effective electrical length of the choke structure.

In one embodiment, the method comprises dimensioning the shielding structure to provide the effective electrical length corresponding to a quarter of a wavelength to be attenuated.

In one embodiment, the method comprises positioning the vias with an inter-via spacing having an effective electrical length corresponding to no more than one tenth of a wavelength to be attenuated.

In one embodiment, the method comprises positioning the vias with an inter-via spacing having an effective electrical length corresponding to no more than one twentieth of the wavelength to be attenuated.

In one embodiment, the method comprises collocating a plurality of the shielding structures to share the portion of the radiating element layer as a common central conductor.

In one embodiment, the method comprises dimensioning each shielding structure to provide one of identical and different effective electrical lengths.

In one embodiment, the plurality of the shielding structures comprises a plurality of the pairs of conductive layers, each separated by a dielectric layer of the printed circuit board assembly.

In one embodiment, the method comprises dimensioning each pair of conductive layers to provide one of identical and different effective electrical lengths.

In one embodiment, the plurality of the shielding structures comprises a plurality of the pairs of bent elements extending from the portion of the radiating element layer.

In one embodiment, each of the plurality of the pairs of bent elements has one of identical and different effective electrical lengths.

In one embodiment, the method comprises providing a plurality of the choke structures.

In one embodiment, the method comprises arranging the plurality of choke structures in series along the radiating element layer.

In one embodiment, the radiating element layer comprises one of a monopole and a dipole.

In one embodiment, the antenna assembly comprises an antenna device comprising the printed circuit board assembly.

In one embodiment, the antenna assembly comprises a radio system comprising the printed circuit board assembly.

Further particular and preferred aspects are set out in the accompanying independent and dependent claims Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide or perform that function.

BRIEF DESCRIPTION OF THE DRAWINGS

Embodiments will now be described further, with reference to the accompanying drawings, in which.

DESCRIPTION OF THE EMBODIMENTS

Before discussing the embodiments in any more detail, first an overview will be provided. In one embodiment, there is provided an assembly or structure. The assembly may be for an antenna or a component thereof. The assembly may comprise a complete antenna device, with or without a mast and/or radio system. The assembly may comprise a printed circuit board assembly or structure. The printed circuit board structure may have a radiating element layer, strip or line. The printed circuit board structure may have a choke structure. The choke structure may have a centrally-located conductor. The choke structure may have a shielding structure. The central-located conductor may be provided by at least a portion of the radiating element layer. Hence, an embodiment provides an arrangement which utilises printed circuit board (PCB) components to produce components of an antenna assembly. In particular, printed circuit board insulating or dielectric layers are provided onto which conductive layers are formed and shaped to provide a radiating element which has a co-located radio frequency (RF) choke. The choke is incorporated together with the radiating element to reduce undesired perturbation. Typically, a shielding structure of each choke is formed in layers surrounding the radiating element. More than one choke structure may be provided on each radiating element. This provides for enhanced reduction of perturbation at a desired frequency through the provision of multiple chokes each operating at that frequency. Alternatively or additionally, this provides for enhanced perturbation at different frequencies through the provision of chokes operating at each of these different frequencies. The choke structures may be provided in series along the length of the radiating element. Each choke structure may utilise a different portion of the radiating element as its central conductor. Multiple chokes may also be provided within each choke structure. For example, a single choke structure may have different length shielding structures formed from conductors provided in the same conductive layer. Alternatively or additionally, multiple chokes can be incorporated in the same choke structure by stacking or nesting the chokes on top of each other, formed from multiple PCB layers.

PCB Choke Structure—General Arrangement

Figure 1:
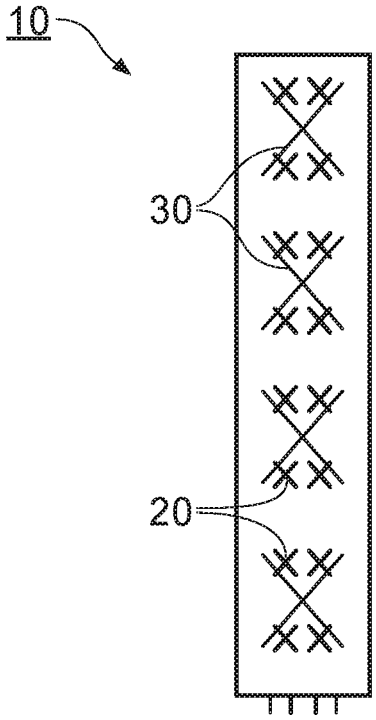
FIG. 1 illustrates an example antenna of the subject matter described herein.
Figure 2:
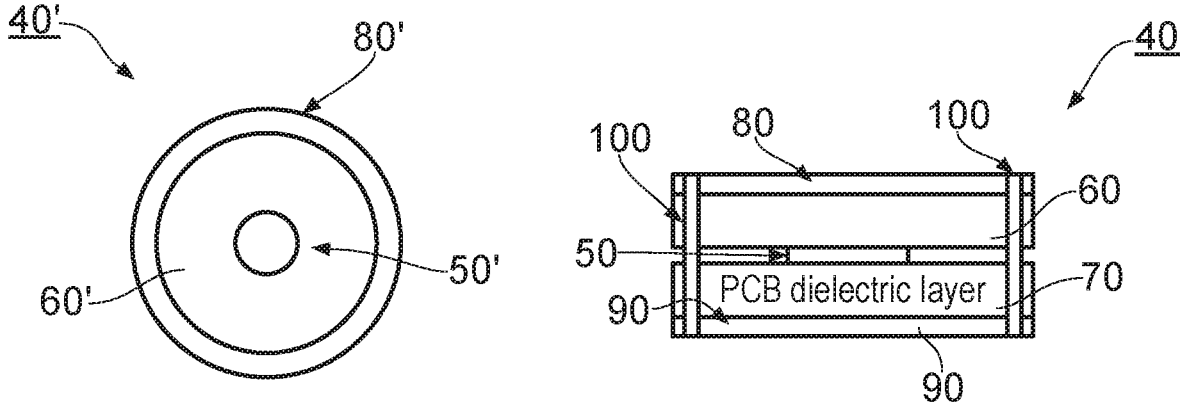
FIG. 2 is a cross-section illustrating an example arrangement of a PCB choke structure of the subject matter described herein and its equivalent features in a coaxial choke.

FIG. 2 is a cross-section illustrating an example arrangement of a PCB choke structure 40 and its equivalent features in a coaxial choke 40'. Such chokes 40' are typically a length of coaxial line shorted at one end and open circuit at the other end, the length of the coaxial line is selected to be quarter of the wavelength of the current to be blocked. A conductive layer 50 is provided in the PCB choke structure 40 which is analogous to a central conductor 50' of the coaxial choke 40'. A first dielectric layer 60 is located along one surface of the conductive layer 50 and a second dielectric layer 70 is provided on the other side of the conductive layer 50; these dielectric layers are equivalent to the dielectric sleeve 60' of the coaxial choke 40'. A conductive layer 80 is provided on the first dielectric layer 60 and a conductive layer 90 is provided on the second dielectric layer 70. Metallised, conductive holes or vias 100 extend between the conductive layers 80 and 90. The combination of the conductive layers 80 and 90 with the vias 100 is equivalent to a coaxial braid 80' of the coaxial choke 40'. Accordingly, it can be seen that the conductor 50 is located within the dielectric layers 60, 70 and surrounded by a shielding structure defined by the conductive layers 80, 90 and the vias 100.

Dipole Antennas

Figure 3:
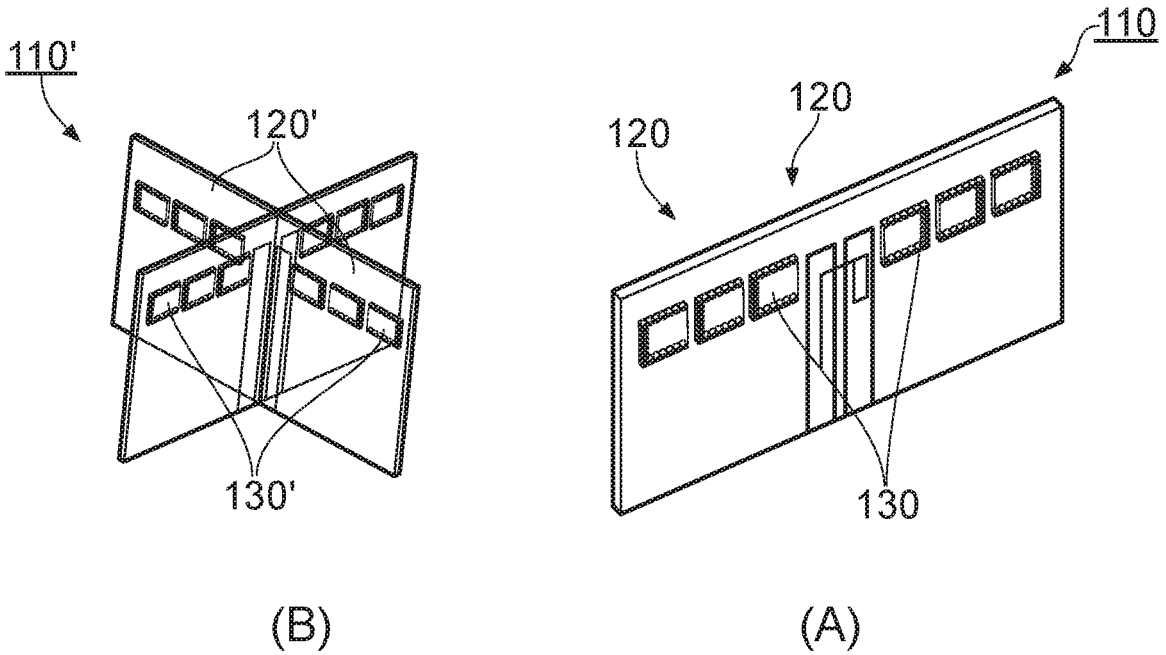
FIG. 3A illustrates a single dipole antenna incorporating a PCB choke structure of the subject matter described herein.
FIG. 3B illustrates a dual dipole antenna incorporating a PCB choke structure of the subject matter described herein.

FIG. 3A illustrates a single dipole antenna 110 arranged as a folded half-wave dipole. The single dipole antenna 110 is formed using a PCB assembly. In particular, as will be explained in more detail below, layers of dielectric and conductors are stacked to form radiating elements 120 having integral chokes 130. In this example, each radiating element 120 has three chokes 130 arranged in series. However, it will be appreciated that fewer or more chokes may be provided.

FIG. 3B illustrates a dual polarised dipole antenna 110' arranged as a folded half-wave dipole. The dual polarised dipole antenna 110' is formed using a PCB assembly. In particular, as will be explained in more detail below, layers of dielectric and conductors are stacked to form radiating elements 120' having integral chokes 130'. In this example, each radiating element 120' has three chokes 130' arranged in series. However, it will be appreciated that fewer or more chokes may be provided.

Choke—1st Arrangement

Figure 4:
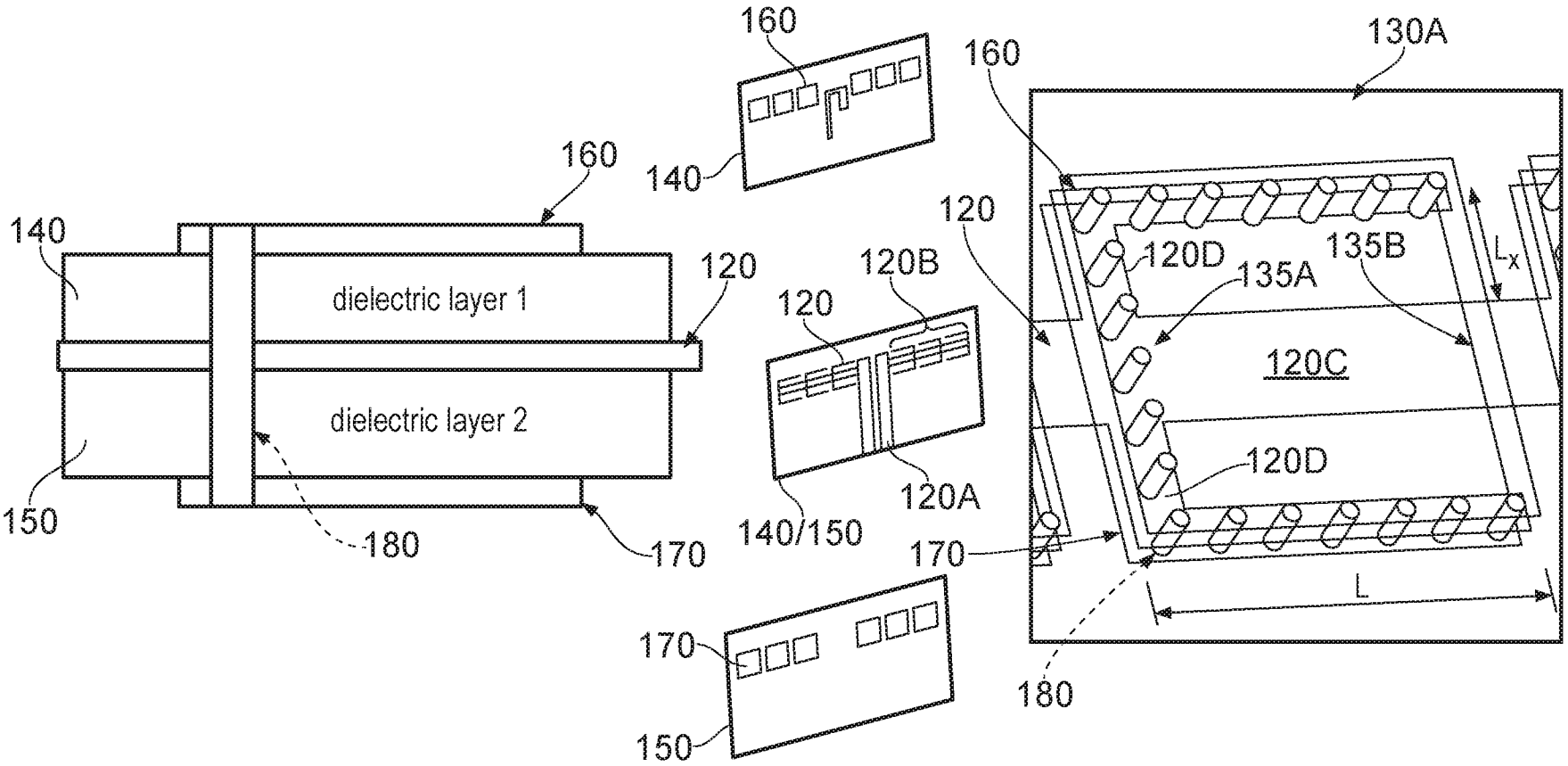
FIG. 4 illustrates an example choke of the subject matter described herein in more detail.

FIG. 4 illustrates an example choke 130A in more detail. As can be seen, the radiating element layer 120 is located, positioned or sandwiched between a first dielectric layer 140 and a second dielectric layer 150 formed into a single PCB board. That is to say, the radiating element layer 120 is sandwiched between adjoining faces of the dielectric layers 140, 150. A conductive layer 160 is formed on an outer face of the dielectric layer 140 and a conductive layer 170 is formed on an outer face of the dielectric layer 150. In another example, intervening layers of adhesive or other such dielectric layers (not shown) may also be sandwiched between the dielectric layers 140, 150 and one or more of the conductive layers 120, 160, 170, or alternatively in other examples, one or more of these adhesive layers may not be present.

The radiating element layer 120 has leg portions 120A and arm portions 120B which form a folded half-wave dipole. The radiating element layer 120 has a portion 120C which is contained within the choke structure 130A. The radiation element layer portion 120C has bent arms 120D which extend away initially from the portion 120C and then run parallel to the portion 120C. The conductive layers 160, 170 are dimensioned to encompass the area defined by the portion 120C and the bent arms 120D. Conductive vias 180 extend from the conductive layer 160 through the dielectric layer 140, the radiating element layer 120, the dielectric layer 150 to the conductive layer 170. The vias 180 electrically couple the conductive layer 160 with the radiating element layer 120 and the conductive layer 170.

The length L of the choke 130A is set to provide an effective electrical length equivalent to a quarter wavelength of a frequency to be blocked (based on the permittivity of the dielectric layers 140, 150). It will be appreciated that although the length L is the major length contributing to the effective electrical length, the complete length of the bent arms 120D (including the length Lx of the part of the bent arms 120D running at away from the portion 120C) contributes to the effective electrical length. The arrangement of the vias 180 at a first end 135A of the choke 130A where the bent arms 120D galvanically connect to the radiating element portion 120 provides for an effective RF short circuit at that end of the choke 130A. A second end 135B of the choke 130A provides for an effective RF open circuit.

Choke—2nd Arrangement

Figure 5:
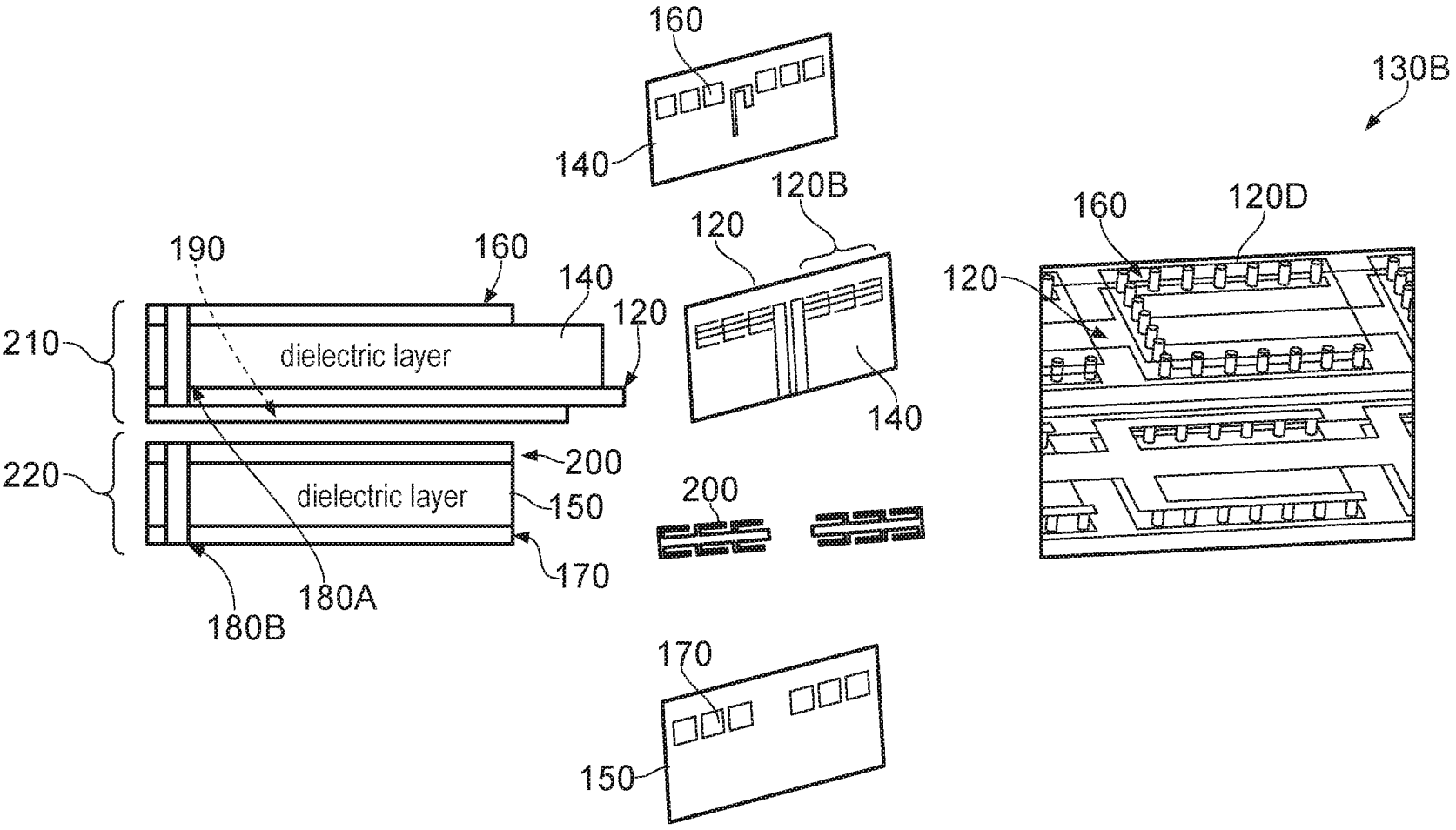
FIG. 5 illustrates an example choke of the subject matter described herein in more detail.

FIG. 5 illustrates an example choke 130B in more detail which share many common features with the arrangement described in FIG. 4 above. In this arrangement, the choke 130B is assembled from two stacked PCB boards 210, 220. The radiating element layer 120 is covered with an insulating layer 190. It will be appreciated that a variety of materials can be used for the insulating layer 190 such as, for example, and not limited to, a varnish. A set of vias 180A are provided which extend from the conductive layer 160 through the dielectric layer 140 to the radiating element layer 120. The vias 180A electrically connect the conductive layer 160 with the radiating element layer 120. The insulating layer 190 covers the end of the vias 180A. The dielectric layer 150 has the conductive layer 170 but also has a conductive layer 200 on the adjoining face. The dielectric layer 150 has conductive vias 180B extending from the conductive layer 170 to the conductive layer 200. As can be seen, the shape of the conductive layer 200 matches the shape of the arms of 120B of the radiating element layer 120, together with the bent arms 120D.

In another example, the radiating element 120 is formed on a first single-sided PCB to keep the cost down and two separate much smaller PCBs are added having the first and second stacked choke PCBs adhered to the first PCB at intervals along its length. The same or similar arrangement could be used as in FIG. 5 but the radiating element 120 would be provided by a separate, very long PCB. The radiating element 120 could also be provided by something other than PCB technology as a further alternative. The vias just need to touch galvanically the radiating element at the right places, as shown in layer 210 of FIG. 5.

Combined Choke—Stacked

While FIGS. 4 and 5 show a single choke 130A, 130B surrounding a portion 120C of the radiating element layer 120, further chokes may be stacked or nested around the choke 130A, 130B by adding additional layers of dielectric and conductor on each side of a common portion 120C. In other words, another choke can be formed by adding a further dielectric layer having a conductive layer on its outer surface on top of the conductive layer 160 and a further dielectric layer having a conductive layer on its outer surface stacked on top of the conductive layer 170.

In the example shown in FIG. 4, the conductive vias 180 would then need to extend between the outermost conductive layers, whereas in the example shown in FIG. 5 the conductive vias would only need to extend between conductive layers of each dielectric layer and have the insulating layer 190 positioned between adjacent printed circuit boards.

The effective electrical length of each choke can be varied mainly by changing the length L (although the length Lx also provides a contribution) and/or by changing the permittivity of the dielectric layers which form the choke 130A, 130B. Hence, it is possible to provide multiple chokes 130A, 130B operating at the same frequency in order to more effectively reduce perturbations within that frequency and/or to provide chokes 130A, 130B operable at different frequencies in order to provide a reduction in perturbation across a range of frequencies by varying their length L (although the length Lx also provides a contribution) or the permittivity of the dielectric layers.

Combined Choke—Multiple Arms

Figure 6:
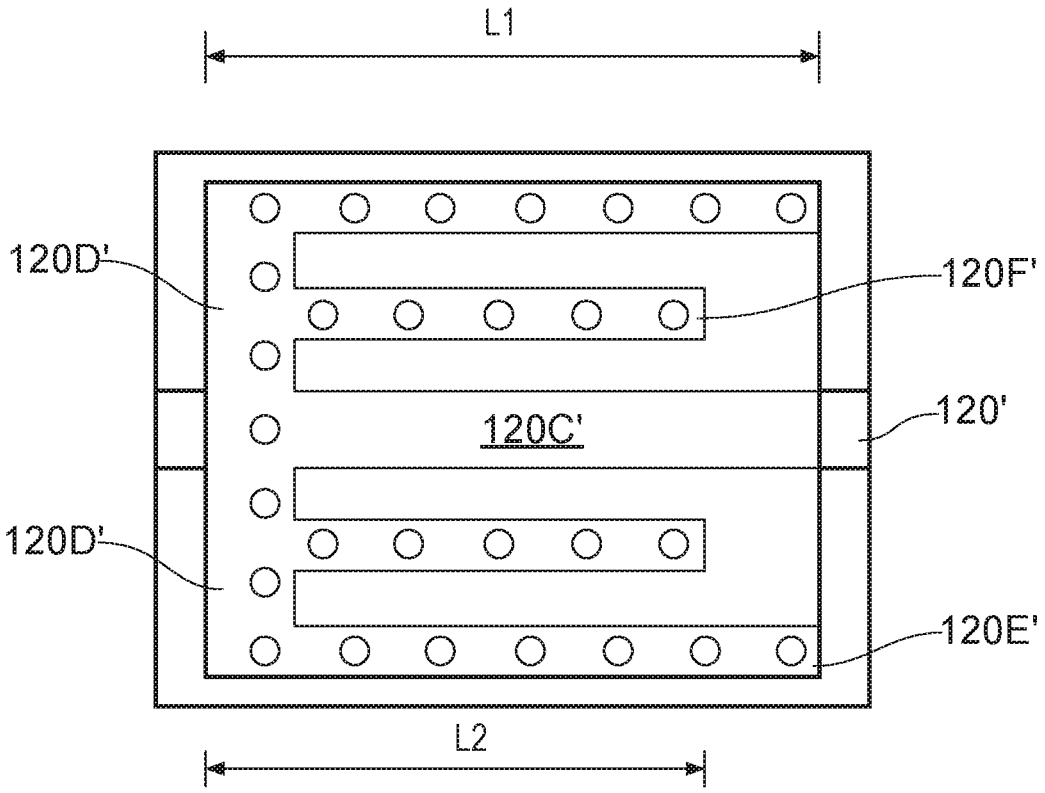
FIG. 6 illustrates the configuration of a radiating element layer a choke of the subject matter described herein in more detail.

FIG. 6 illustrates the configuration of a radiating element layer 120' of a choke operable to reduce perturbations at different frequencies through the provision of multiple arms. In this arrangement, the portion 120C' of the radiating element layer 120' has branching bent arms 120D'. A first branch 120E' extends for the length L1, whereas a second branch 120F' extends for the length L2. The remaining structure of the choke is constructed as shown in FIG. 4 or FIG. 5 above. Providing the dual arms 120E', 120F' provides a choke which attenuates signals at two frequencies based on the effective electrical length of the choke, which is dependent mainly on the lengths L1 and L2 (as mentioned above).

An embodiment provides a technique to implement chokes in full printed circuit board (PCB) technology, which has many advantages over metal sheet or metallized plastic technologies. The coaxial line of the choke is created by a stack-up of several metallised layers and dielectric layers as shown in FIG. 2. The shielding of the choke across the metal layers is obtained by several metallized holes. Knowing that the length of a dipole is usually designed at 0.5 wavelength, this dipole is also able to radiate at higher frequencies (2nd, 3rd or higher harmonic). An embodiment avoids harmonic radiation of the dipole at these higher harmonic frequencies by placing sufficient/several PCB chokes directly on the radiating part of a PCB dipole.

In a first implementation shown in FIG. 4, a dipole with integrated chokes is realised on a multilayer PCB. The coaxial line of the choke is realized by 3 conductive layers and 2 dielectric layers. The shielding of the coaxial choke is obtained by several metallized vias between all the conductive layers. The distance between 2 consecutive vias is short compared to the high band wavelength to be trapped (not greater than a 10% of a wavelength, typically 5%).

In this first implementation, the dipole with the chokes is directly obtained from PCB manufacturing, with all the advantages inherent to this technology and associated processes (high precision, complex shapes easy to do due to printing technology). A drawback is that multilayer PCB technology is not low cost, but it may be acceptable if high-precision positioning is required, for example in the case of very high frequencies.

In a second implementation shown in FIG. 5, the dipole with integrated chokes is realized on two conventional PCB boards. The shielding of the choke is obtained by metallized holes on one PCB board, and with a capacitive coupling link associated with metallized holes on the other PCB board. The insulation of the capacitive coupling part is obtained by a thin dielectric layer, for example varnish on one or both of the PCB faces. The second PCB area can be limited to the choke region, and one PCB board can be maintained against the other PCB by plastic rivets or other parts.

The first advantage of using PCB technology is process stability and precision compared to conventional methods to realize chokes on radiating elements, like mechanical crimping, screwing or welding or rivet assembly processes.

The length of the choke is approximately a quarter of a wavelength in the coaxial line for the high-band frequency to be trapped. As the choke is filled with the PCB dielectric, its physical length is shorter, and a higher number of chokes can be positioned along the low-band element. The result is a better efficiency for high-band filtering.

The PCB technology also allows the manufacture of very complex shapes due to a printing process. For example, a corrugated choke such as that illustrated in FIG. 6 can be easily implemented if a wider high-band bandwidth rejection is required.

The chokes using PCB technology as described can be used for the radiating arms of dipoles or monopoles, but also on the balun legs parts if required, as well as for eventual parasitic or matching elements located over the dipoles or monopoles.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labelled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. An antenna assembly, comprising:

a printed circuit board assembly having a radiating element layer sandwiched between a pair of dielectric layers, said radiating element layer forming a dipole antenna comprising two arms, each arm of said dipole antenna having a choke structure, said choke structure having a central conductor and a shielding structure, wherein said central conductor comprises at least a portion of said radiating element layer, and wherein said portion of said radiating element layer corresponds to a portion of said dipole arms;

wherein said shielding structure comprises a pair of conductive layers separated from said portion of said radiating element layer by a respective one of said pair of dielectric layers of said printed circuit board assembly;

wherein said shielding structure comprises conductive vias extending through said pair of conductive layers, said pair of dielectric layers and said portion of said radiating element layer and wherein the vias electrically couple the pair of conductive layers with the portion of the radiating element layer;

wherein said central conductor of said choke structure comprises a pair of L-shaped elements which extend initially away and in opposite directions from said central conductor and turn to extend generally parallel to said central conductor and wherein said L-shaped elements are dimensioned to provide an effective electrical length corresponding to a quarter of a wavelength of a frequency to be blocked.

2. The antenna assembly of claim 1, wherein said vias are positioned with an inter-via spacing having an effective electrical length corresponding to no more than one tenth of a wavelength of a frequency to be attenuated.

3. The antenna assembly of claim 1, comprising multiple shielding structures collocated to share said portion of said radiating element layer as a common central conductor.

4. The antenna assembly of claim 3, wherein said multiple shielding structures comprise a plurality of said pairs of conductive layers, each separated a dielectric layer.

5. The antenna assembly of claim 3 wherein said multiple shielding structures comprise a plurality of said pairs of L-shaped elements extending from said central conductor.

6. The antenna assembly of claim 1, comprising multiple choke structures.

7. The antenna assembly of claim 6, wherein said multiple choke structures are arranged in series along said radiating element layer.

8. An antenna device comprising said antenna assembly of claim 7.

9. An antenna device comprising said antenna assembly of claim 1.

10. A method, comprising:

providing a printed circuit board assembly having a radiating element layer sandwiched between a pair of dielectric layers, said radiating element layer forming a dipole antenna comprising two arms, each arm of said dipole antenna having a choke structure, said choke structure having a central conductor and a shielding structure, wherein said central conductor comprises at least a portion of said radiating element layer, and wherein said portion of said radiating element layer corresponds to a portion of said dipole arms, wherein said shielding structure comprises a pair of conductive layers separated from said portion of said radiating element layer by a respective one of said pair of dielectric layers of said printed circuit board assembly, wherein said shielding structure comprises conductive vias extending through said pair of conductive layers, said pair of dielectric layers and said portion of said radiating element layer;

electrically coupling the pair of conductive layers with the portion of the radiating element layer with the vias, wherein said central conductor of said choke structure comprises a pair of L-shaped elements which extend initially away and in opposite directions from said central conductor and turn to extend generally parallel to said central conductor; and dimensioning said L-shaped elements to provide an effective electrical length corresponding to a quarter of a wavelength of a frequency to be blocked.

11. An antenna assembly, comprising:

first and second stacked printed circuit boards;

wherein the first printed circuit board comprises, a first dielectric layer, a first conductive layer, a radiating element layer, and an insulating layer;

wherein the second printed circuit board comprises, a second dielectric layer, a second conductive layer, and a further conductive layer;

said first dielectric layer having said radiating element layer formed on a first surface facing said second dielectric layer and the first conductive layer formed on a second surface facing away from said second dielectric layer;

said second dielectric layer having the second conductive layer formed on a surface facing away from said first dielectric layer and the further conductive layer formed on a surface facing said first dielectric layer and said insulating layer is positioned between said first radiating element layer and said surface of the second dielectric layer facing the first dielectric layer;

said radiating element layer forming a dipole antenna comprising two arms, each arm of said dipole antenna having a choke structure, said choke structure having a central conductor and a shielding structure, wherein said central conductor comprises at least a portion of said radiating element layer, and wherein said portion of said radiating element layer corresponds to a portion of said dipole arms, and wherein said shielding structure comprises the first, second, and further conductive layers;

a first set of vias extending from the first conductive layer through the first dielectric layer to the radiating element layer, wherein the vias electrically connect the first conductive layer with the radiating element layer;

a second set of vias extending from the second conductive layer to the further conductive layer;

wherein said central conductor of said choke structure comprises a pair of L-shaped elements which extend initially away and in opposite directions from said central conductor and turn to extend generally parallel to said central conductor and wherein said L-shaped elements are dimensioned to provide an effective electrical length corresponding to a quarter of a wavelength of a frequency to be blocked.

12. The antenna assembly of claim 11, wherein said vias are positioned with an inter-via spacing having an effective electrical length corresponding to no more than one tenth of a wavelength of a frequency to be attenuated.

13. The antenna assembly of claim 11, comprising multiple shielding structures collocated to share said portion of said radiating element layer as a common central conductor.

14. The antenna assembly of claim 13, wherein said multiple shielding structures comprise a plurality of said first, second, and further conductive layers, each separated a dielectric layer.

15. The antenna assembly of claim 13 wherein said multiple shielding structures comprise a plurality of said pairs of L-shaped elements extending from said central conductor.

16. The antenna assembly of claim 11, comprising multiple choke structures.

17. The antenna assembly of claim 16, wherein said multiple choke structures are arranged in series along said radiating element layer.

18. A method, comprising:

providing first and second stacked printed circuit boards, wherein the first printed circuit board comprises, a first dielectric layer, a first conductive layer, a radiating element layer, and an insulating layer, wherein the second printed circuit board comprises, a second dielectric layer, a second conductive layer, and a further conductive layer, said first dielectric layer having said radiating element layer formed on a first surface facing said second dielectric layer and the first conductive layer formed on a second surface facing away from said second dielectric layer, said second dielectric layer having the second conductive layer formed on a surface facing away from said first dielectric layer and the further conductive layer formed on a surface facing said first dielectric layer and said insulating layer is positioned between said first radiating element layer and said surface of the second dielectric layer facing the first dielectric layer, said radiating element layer forming a dipole antenna comprising two arms, each arm of said dipole antenna having a choke structure, said choke structure having a central conductor and a shielding structure, wherein said central conductor comprises at least a portion of said radiating element layer, and wherein said portion of said radiating element layer corresponds to a portion of said dipole arms, and wherein said shielding structure comprises the first, second, and further conductive layers, a first set of vias extending from the first conductive layer through the first dielectric layer to the radiating element layer and a second set of vias extending from the second conductive layer to the further conductive layer;

electrically coupling the first conductive layer with the radiating element layer with the first set of vias, wherein said central conductor of said choke structure comprises a pair of L-shaped elements which extend initially away and in opposite directions from said central conductor and turn to extend generally parallel to said central conductor; and dimensioning said L-shaped elements to provide an effective electrical length corresponding to a quarter of a wavelength of a frequency to be blocked.

* * * * *